US010654706B2

(12) United States Patent
Lacey et al.

(10) Patent No.: US 10,654,706 B2
(45) Date of Patent: May 19, 2020

(54) SADDLE TREE AND A METHOD FOR LIMITING UPWARD TRAVEL OF A SEAT FORMING ELEMENT RELATIVE TO A BACK ENGAGING ELEMENT OF THE SADDLE TREE

(71) Applicant: Lam Technologies Limited, Dublin (IE)

(72) Inventors: William Vincent Lacey, Dunboyne (IE); Austin Conboy, Dublin (IE); Martin Patrick Ryan, Dublin (IE)

(73) Assignee: Lam Technologies Limited, Dundrum, Dublin (IE)

( * ) Notice: Subject to any disclaimer, the term of this patent is extended or adjusted under 35 U.S.C. 154(b) by 393 days.

(21) Appl. No.: 15/326,302

(22) PCT Filed: Jul. 16, 2015

(86) PCT No.: PCT/IE2015/000008
§ 371 (c)(1),
(2) Date: Jan. 13, 2017

(87) PCT Pub. No.: WO2016/009417
PCT Pub. Date: Jan. 21, 2016

(65) Prior Publication Data

US 2017/0203953 A1 Jul. 20, 2017

(30) Foreign Application Priority Data

Jul. 16, 2014 (IE) ..... S2014/0168

(51) Int. Cl.
*B68C 1/02* (2006.01)
*B68C 1/04* (2006.01)

(52) U.S. Cl.
CPC ..... *B68C 1/025* (2013.01); *B68C 1/04* (2013.01)

(58) Field of Classification Search
CPC ..... B68C 1/02; B68C 1/10; B68C 2001/022; B68C 1/025; B68C 1/04; B68C 2001/042;
(Continued)

(56) References Cited

U.S. PATENT DOCUMENTS 633,236 A * 9/1899 Eatman ..... B68C 1/10 54/44.4
1,181,026 A * 4/1916 Maslen ..... B62J 1/02 248/419

(Continued)

FOREIGN PATENT DOCUMENTS

DE 4414789 A1 * 11/1995 ..... B68C 1/04
DE 20 2008 009 602 U1 9/2008

(Continued)

OTHER PUBLICATIONS

Machine translation of FR 324250 to Jansen, published Mar. 1903.*

(Continued)

*Primary Examiner* — Kathleen I Alker
(74) *Attorney, Agent, or Firm* — Sughrue Mion, PLLC

(57) ABSTRACT

A saddle tree comprising a back engaging element (3) for engaging and sitting on the back of an animal and a seat forming element (4) resiliently coupled to the back engaging element (3) adjacent the pommel (5) by a pair of resilient mounting members (8). A limit strap (17) is anchored to the back engaging element (3) and is adjustably coupled to the seat forming element (4) by a ratchet mechanism (20). The limit strap (17) terminates in a grippable element (32) which is releasably grippable by the ratchet mechanism (20). By urging the grippable element (32) in the direction of the arrow A through the ratchet mechanism (20), the limit of upward travel of the seat forming element (4) relative to the back engaging element (3) is reduced, thereby effectively hardening the saddle.

19 Claims, 3 Drawing Sheets

(58) Field of Classification Search
CPC ..... B68C 2001/044; B68C 2001/046; B68C 2001/048; B62J 1/00; B62J 1/02; B62J 1/04; B62J 1/10
See application file for complete search history.

(56) References Cited

U.S. PATENT DOCUMENTS 2,167,889 A * 8/1939 Hulse ..... A01K 13/005 54/78
2,392,053 A * 1/1946 McAuliffe ..... B68B 1/04 280/186
4,018,035 A * 4/1977 Morrison ..... B68C 1/14 54/23
4,502,727 A * 3/1985 Holcomb ..... B62J 1/04 297/209
4,765,276 A * 8/1988 Kime ..... A01K 15/027 340/12.5
4,905,458 A * 3/1990 Johnston ..... B68C 1/14 54/23
5,809,754 A * 9/1998 Schulte ..... B68C 3/00 54/47
7,455,356 B2 * 11/2008 Park ..... B62J 1/02 297/195.1
7,681,899 B2 * 3/2010 Fujiwara ..... B62J 1/06 280/283
7,721,514 B1 * 5/2010 Pierce ..... A01K 15/027 224/905
2008/0238161 A1 * 10/2008 Huyck ..... A63B 22/0605 297/215.13
2011/0094275 A1 * 4/2011 Contarino, Jr. ..... B68C 1/00 70/58
2012/0017548 A1 1/2012 Baio
2013/0334787 A1 * 12/2013 Gosseen ..... B62J 1/10 280/200
2014/0338292 A1 * 11/2014 Abel ..... B68C 1/002 54/44.1

FOREIGN PATENT DOCUMENTS

EP 2 327 657 A1 6/2011
FR 324250 A * 3/1903 ..... B68C 1/02
FR 2 819 798 A1 7/2002
GB 124924 A * 4/1919 ..... B68C 1/00
WO 2007/015225 A1 2/2007

OTHER PUBLICATIONS

Machine translation of FR 2819798 to Vacher, published Jul. 2002, cited on Jan. 13, 2017 IDS.*
Written Opinion of the International Searching Authority of PCT/IE2015/000008 dated Sep. 23, 2015.
International Search Report of PCT/IE2015/000008 dated Sep. 23, 2015.

* cited by examiner

SADDLE TREE AND A METHOD FOR LIMITING UPWARD TRAVEL OF A SEAT FORMING ELEMENT RELATIVE TO A BACK ENGAGING ELEMENT OF THE SADDLE TREE

CROSS REFERENCE TO RELATED APPLICATIONS

This application is a National Stage of International Application No. PCT/IE2015/000008 filed Jul. 16, 2015, claiming priority based on Irish Patent Application No. S2014/0168 filed Jul. 16, 2014, the contents of all of which are incorporated herein by reference in their entirety.

The present invention relates to a saddle tree, and in particular, though not limited to a saddle tree suitable for a saddle of the type for saddling a horse, a pony, a donkey or other such four-legged animals. The invention also relates to a method for limiting upward movement of a seat forming element of a saddle tree relative to the back engaging element of the saddle tree whereby the limit of upward travel is adjustable.

Saddles for saddling a horse, a pony, donkey and other such four-legged animals constructed from a saddle tree are well known. In general, the saddle tree comprises a back engaging element for engaging the back of the animal, and a seat forming element, which in general is suitably upholstered for forming a saddle. In some saddle tree constructions, the seat forming element is resiliently mounted on the back engaging element in order to accommodate movement of the back of the animal, and to minimise transfer of the movement of the back of the animal to the seat forming element. The resilient mounting of the seat forming element on the back engaging element also provides a more comfortable ride for the rider. Resiliently mounting of a seat forming element to the back engaging element of a saddle tree may be carried out by mounting the seat forming element on compression springs, which in turn are carried on the back engaging element. An alternative construction of a saddle tree is disclosed in PCT published Application Specification No. WO 2007/015225, whereby the back engaging element comprises a pair of back engaging panels which engage the back of the animal on opposite sides of the animal's spine, and the seat forming element is resiliently coupled to the back engaging panels by a pair of resilient mounting elements located adjacent the pommel, and extending upwardly from the respective back engaging panels.

A problem which arises with saddle trees in which the seat forming element is resiliently mounted on the back engaging element in order to permit movement of the back engaging element relative to the seat forming element and vice versa is that the resilient movement which is allowed between the seat forming element and the back engaging element may be too great. In other words, when the upward travel of the seat forming element relative to the back engaging element which is permitted by the resilient mounting of the seat forming element relative to the back engaging element is too great, the saddle can feel too soft to a rider, while on the other hand, where the upward travel of the seat forming element relative to the back engaging element which is permitted by the resilient mounting of the seat forming element on the back engaging element is insufficient, the saddle can feel too hard to a rider. However, the desired amount of travel permitted between the seat forming element and the back engaging element of a saddle tree is a matter of taste, and varies from rider to rider. Accordingly, there is a need to address this problem.

The present invention is directed towards providing a saddle tree which addresses this problem, and the invention is also directed towards a method which addresses the problem.

According to the invention there is provided a saddle tree comprising a back engaging element for engaging the back of an animal, a seat forming element resiliently mounted on the back engaging element and being resiliently moveable relative to the back engaging element, and a limit means connected between the seat forming element and the back engaging element for limiting upward travel of the seat forming element relative to the back engaging element, the limit means being adjustable for adjusting the limit of upward travel of the seat forming element relative to the back engaging element.

In one aspect of the invention the limit means is connected between the seat forming element and the back engaging element intermediate the pommel and the cantle of the seat forming element.

Preferably, the limit means is connected between the seat forming element and the back engaging element substantially midway between the pommel and the cantle of the seat forming element.

Advantageously, the limit means is connected to the seat forming element at a location through which the load borne by the seat forming element acts.

In one aspect of the invention the limit means is anchored to one of the back engaging element and the seat forming element, and is adjustably coupled to the other one of the back engaging element and the seat forming element for adjusting the limit of upward travel of the seat forming element relative to the back engaging element.

In a further aspect of the invention the limit means comprises an elongated limit member extending between the back engaging element and the seat forming element, the effective length of the limit means extending between the back engaging element and the seat forming element being adjustable for adjusting the limit of upward travel of the seat forming element relative to the back engaging element.

Preferably, the limit means is adjustably coupled to the one of the back engaging element and the seat forming element by an adjusting means.

Advantageously, the adjusting means is coupled to one of the limit means, and the one of the back engaging element and the seat forming element to which the limit means is adjustably coupled, and is co-operable with the other one of the limit means, and the one of the back engaging element and the seat forming element to which the limit means is adjustably coupled for adjusting the limit of upward travel of the seat forming element relative to the back engaging element.

In another aspect of the invention the adjusting means comprises a ratchet mechanism.

Preferably, the ratchet mechanism comprises a ratchet element carried on one of the limit means, the seat forming element and the back engaging element, on which the adjusting means is located, and a plurality of spaced apart ratchet teeth located on the one of the limit means, the seat forming element and the back engaging element, with which the adjusting means is co-operable, the ratchet element being releasably engageable with a selected one of the ratchet teeth for adjusting the effective length of the limit means extending between the back engaging element and the seat forming element.

Advantageously, the ratchet teeth are located on the limit means.

In another aspect of the invention the limit means terminates in a grippable element comprising the ratchet teeth.

Preferably, the adjusting means is configured to permit quick release of the limit means from the one of the seat forming element and the back engaging element to which the limit means is adjustably coupled.

In another aspect of the invention the adjusting means is located on the seat forming element.

Preferably, the limit means comprises a flexible limit member. Advantageously, the limit means comprises a limit strap.

In one aspect of the invention a resilient mounting means extending between the back engaging element and the seat forming element resiliently couples the seat forming element to the back engaging element.

In another aspect of the invention the resilient mounting means is configured to permit resilient movement of the seat forming element relative to the back engaging element in a generally upwardly/downwardly direction.

Preferably, the resilient mounting means is located adjacent the pommel.

In another aspect of the invention the seat forming element is cantilevered rearwardly from the resilient mounting means towards the cantle. Preferably, the seat forming element is solely supported on the back engaging element by the resilient mounting means.

Advantageously, the limit means is connected between the seat forming element and the back engaging element spaced apart rearwardly from the resilient mounting means.

In another aspect of the invention the back engaging element comprises a pair of side panels for engaging the back of the animal on respective opposite sides of the spine of the animal, and the side panels of the back engaging elements terminate in the resilient mounting means adjacent the pommel.

Preferably, the resilient mounting means comprises a pair of spaced apart mounting members extending upwardly from the respective ones of the side panels of the back engaging element adjacent the pommel, and engaging the seat forming element adjacent the pommel for resiliently coupling the seat forming element to the side panels. Advantageously, the mounting members are of a resilient material.

In another aspect of the invention the side panels of the back engaging element are connected together intermediate the pommel and the cantle by a coupling element. Preferably, the coupling element is of a resilient material for resiliently coupling the side panels of the back engaging element to each other intermediate the pommel and the cantle.

In another aspect of the invention the limit means is coupled to the back engaging element adjacent the coupling element.

Preferably, the limit means is anchored to the coupling element of the back engaging element.

The invention also provides a method for limiting upward travel of a seat forming element of a saddle tree relative to a back engaging element of the saddle tree whereby the back engaging element of the saddle tree is configured for engaging the back of an animal, and the seat forming element is resiliently mounted on the back engaging element for permitting relative movement of the seat forming element relative to the back engaging element, the method comprising connecting a limit means between the seat forming element and the back engaging element for limiting the upward travel of the seat forming element relative to the back engaging element, and providing the limit means to be adjustable for adjusting the limit of upward travel of the seat forming element relative to the back engaging element.

The advantages of the saddle tree according to the invention are many. A particularly important advantage of the invention is that it provides a saddle tree in which the hardness and softness of a saddle formed by the seat forming element can be adjusted, in other words, the saddle tree according to the invention provides a seat forming element which is resiliently mounted on the back engaging element of the saddle tree, thereby permitting relative movement, and in particular, upward and downward relative movement of the seat forming element relative to the back engaging element of the saddle tree and the limit of upward movement of the seat forming element relative to the back engaging element is adjustable in order to provide a comfortable ride for a rider. By providing the limit means for limiting the upward travel of the seat forming element relative to the back engaging element of the saddle tree to be adjustable, the effective hardness and softness of the saddle can be readily adjusted. The more the upward travel of the seat forming element relative to the back engaging element of the saddle tree is limited, the effective hardness of the saddle will be increased. Increasing the permitted amount of upward travel of the seat forming element relative to the back engaging element results in effective softening of the saddle.

The invention will be more clearly understood from the following description of a preferred embodiment thereof, which is given by way of example only, with reference to the accompanying drawings, in which.

Figure 2:
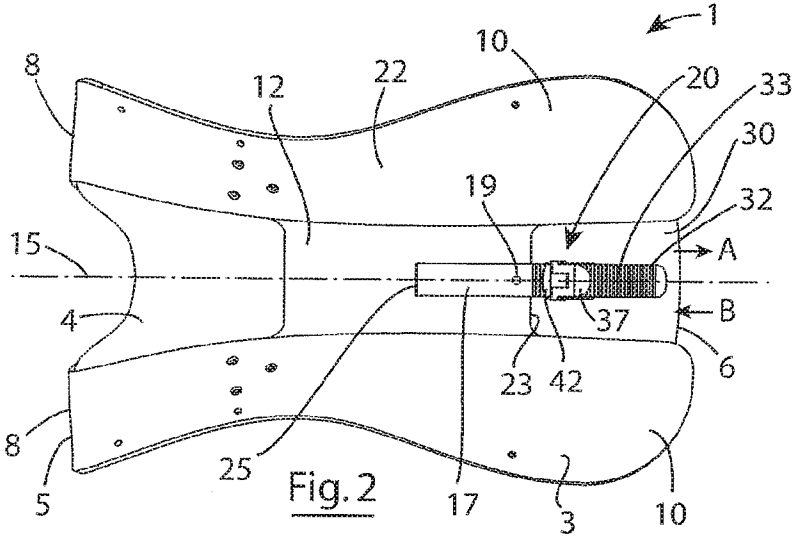
FIG. 2 is an underneath plan view of the saddle tree of FIG. 1.
Figure 4:
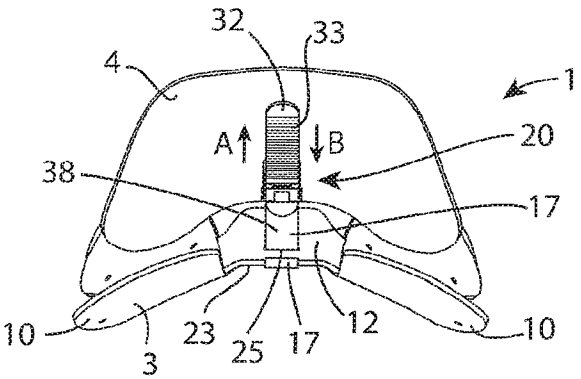
FIG. 4 is a rear end elevational view of the saddle tree of FIG. 1.
Figure 1:
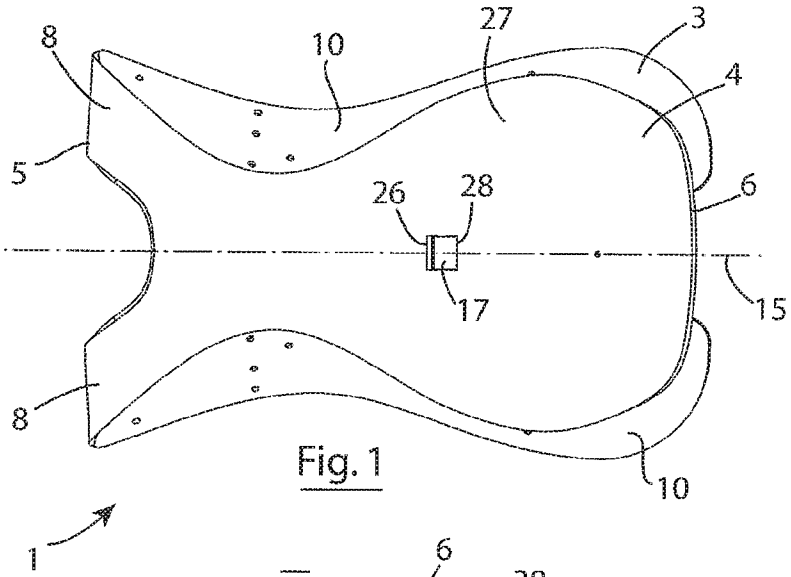
FIG. 1 is a top plan view of a saddle tree according to the invention.
Figure 3:
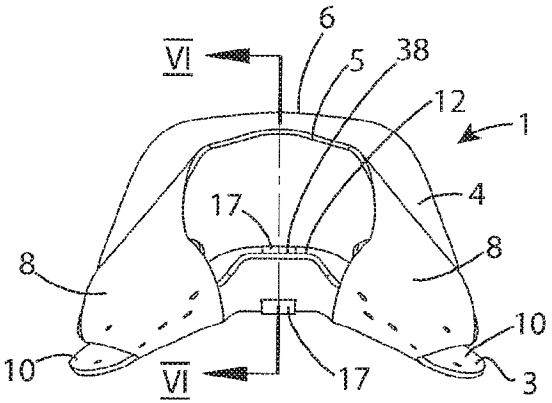
FIG. 3 is a front end elevational view of the saddle tree of FIG. 1.
Figure 5:
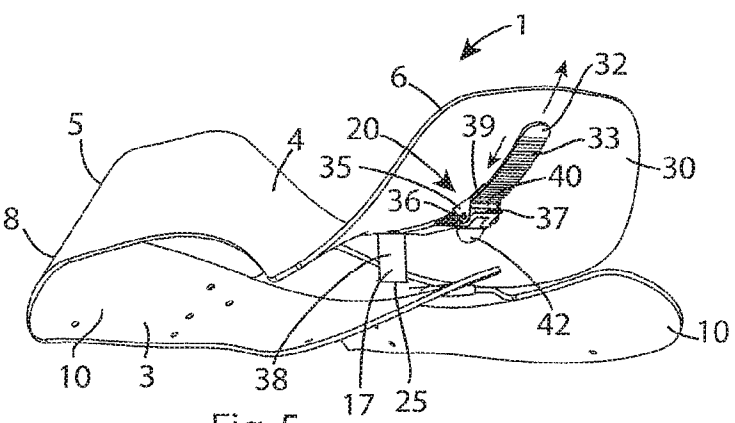
FIG. 5 is a perspective view of the saddle tree of FIG. 1.
Figure 7:
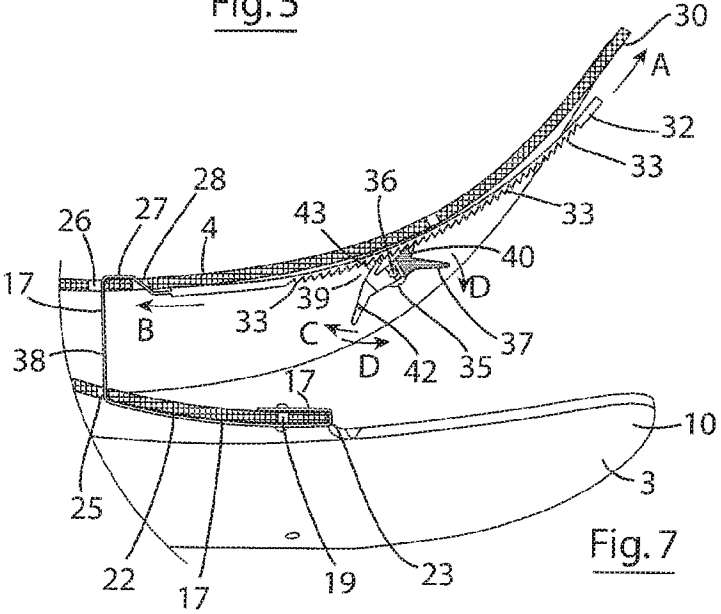
Figure 6:
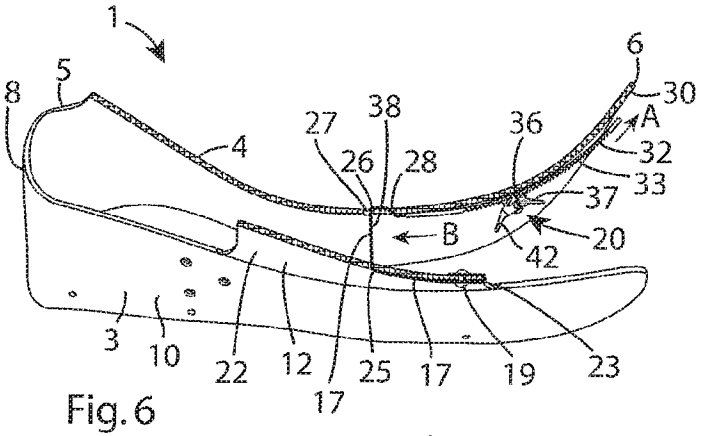
Figure 8:
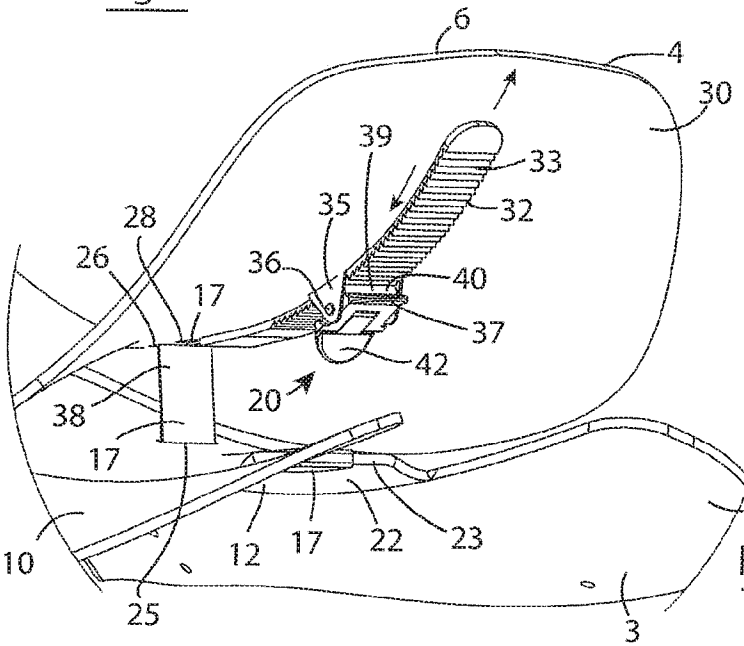
Figure 9:
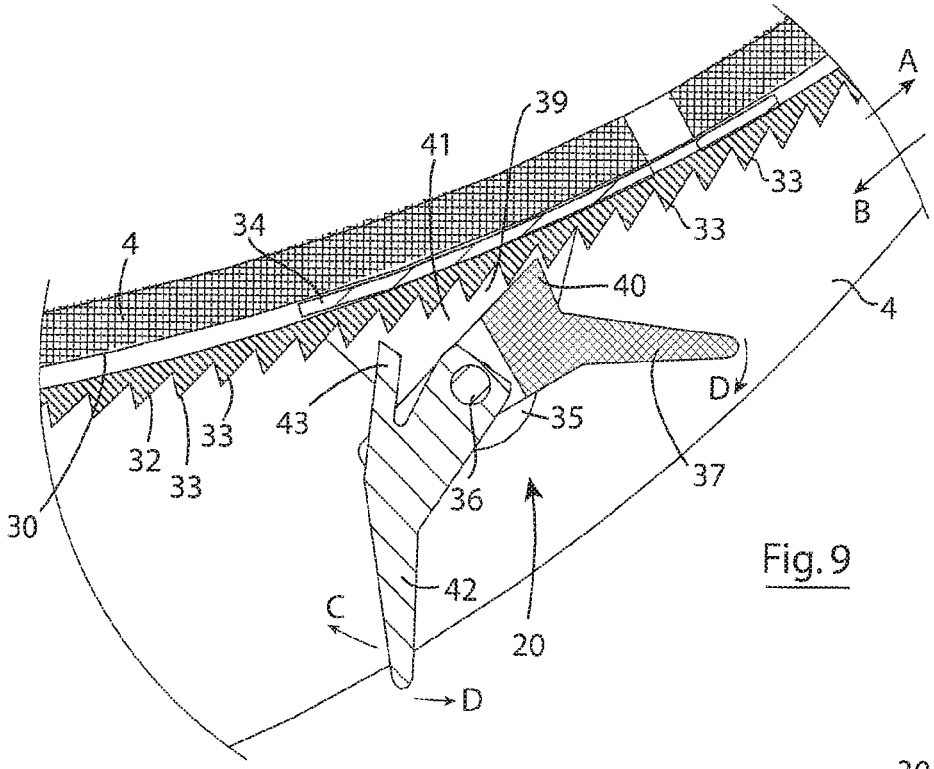
Figure 10:
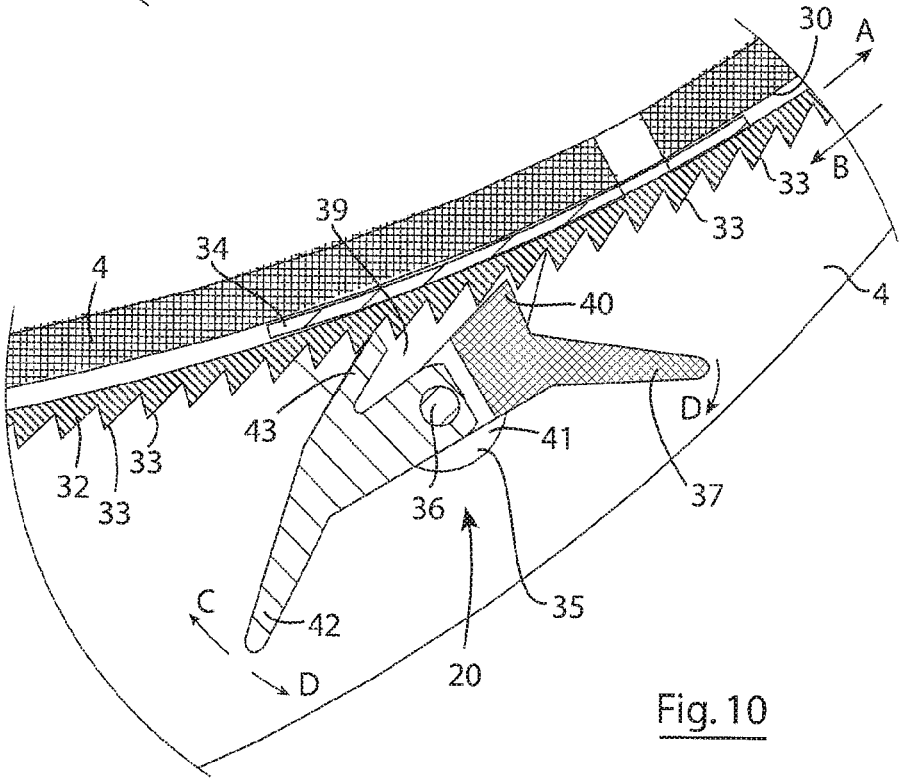

FIG. 6 is a cross-sectional side elevational view of the saddle tree of FIG. 1 on the line VI-VI of FIG. 3, FIG. 7 is an enlarged cross-sectional side elevational view of a portion of the saddle tree of FIG. 1, FIG. 8 is an enlarged perspective view of a detail of the saddle tree of FIG. 1, FIG. 9 is an enlarged cross-sectional side elevational view of a detail of the saddle tree of FIG. 1, and FIG. 10 is a view similar to FIG. 9 of the detail of FIG. 9 illustrating a portion of the detail of FIG. 9 in a different state to that of FIG. 9.

Referring to the drawings, there is illustrated a saddle tree according to the invention, indicated generally by the reference numeral 1, for a saddle of the type suitable for saddling a horse, a pony, a donkey or other such four-legged animal. The saddle tree 1 comprises a back engaging element 3 for engaging and sitting on the back of an animal, and a seat forming element 4, which extends between a forward end or pommel 5 of the saddle tree 1, and a rear end, or cantle 6 of the saddle tree 1. A resilient mounting means, namely, a pair of spaced apart resilient mounting members 8 extending between the back engaging element 3 and the seat forming element 4 adjacent the pommel 5 resiliently support the seat forming element 4 on the back engaging element 3. In this embodiment of the invention the seat forming element 4 is solely supported on the back engaging element 3 by the resilient mounting members 8, and is cantilevered rearwardly from the resilient mounting members 8.

The back engaging element 3 comprises a pair of side panels 10 which are configured and shaped for engaging the back of the animal on respective opposite sides of the spine of the animal adjacent the spine. The side panels 10 are joined by a resilient coupling element 12 which extends between the side panels 10 intermediate the pommel 5 and the cantle 6 so that the side panels 10 diverge outwardly downwardly from the coupling element 12. The resilience of the coupling element 12 permits relative resilient movement of the side panels 10 relative to each other in order to accommodate movement of the back of the animal during walking, cantering and galloping.

The side panels 10 terminate at the pommel 5 in the respective resilient mounting members 8, which are of arcuate shape and extend upwardly from the side panels 10 to the seat forming element 4 on opposite sides of a centre line 15 of the saddle tree 1 adjacent the pommel 5. The resilient mounting members 8 as well as resiliently supporting the seat forming element 4 on the back engaging element 3 also act through the seat forming element 4 for resiliently coupling the side panels 10 adjacent the pommel 5 to each other.

The resilient mounting members 8 permit upward and downward travel of the seat forming element 4 relative to the back engaging element 3 as the seat forming element 4 essentially pivots about a forward transversely extending imaginary pivot axis defined by the resilient mounting members 8. As well as permitting upward and downward travel of the seat forming element 4 relative to the back engaging element 3, the resilient mounting members 8 also permit resilient movement of the side panels 10 relative to the seat forming element 4 independently of each other.

A limit means for limiting the upward travel of the seat forming element 4 relative to the back engaging element 3 comprises an elongated limit member, which in this embodiment of the invention comprises an elongated limit strap 17, which is connected between the back engaging element 3 and the seat forming element 4, and is adjustably coupled to the seat forming element 4 as will be described below for adjusting the limit of the upward travel of the seat forming element 4 relative to the back engaging element 3. In this embodiment of the invention the limit strap 17 is anchored to the coupling element 12 of the back engaging element 3 by a rivet 19, and is adjustably coupled to the seat forming element 4 by an adjusting means, in this embodiment of the invention provided by a ratchet mechanism 20, in order to permit adjustment of the limit strap 17 relative to the seat forming element 4. The limit strap 17 is non-elastic, and is flexible, and is of a woven nylon material.

The limit strap 17 extends along an underside 22 of the coupling element 12 from a rear end 23 thereof at which the limit strap 17 is folded over the coupling element 12 to sandwich the coupling element 12 therebetween, and the rivet 19 engages the limit strap 17 both above and below the coupling element 12. The limit strap 17 extends through an opening, namely, a first strap accommodating slot 25 extending through the coupling element 12, and in turn through an opening, namely, a second strap accommodating slot 26 extending through the seat forming element 4. The limit strap 17 extends along an upper surface 27 of the seat forming portion 4 to a third opening, namely, a third strap accommodating slot 28 extending through the seat forming element 4 through which the limit strap 17 extends downwardly and in turn extends rearwardly along an under surface 30 of the seat forming element 4 to the ratchet mechanism 20.

The limit strap 17 terminates along the under surface 30 of the seat forming element 4 in an elongated flexible grippable element 32 which comprises a plurality of parallel transversely extending spaced apart angled ridges which form ratchet teeth 33 with which the ratchet mechanism 20 co-operates for securing the limit strap 17 to the seat forming element 4 with the limit of upward movement of the seat forming element 4 relative to the back engaging element 3 set at a desired limit.

The ratchet mechanism 20 is mounted on the seat forming element 4 on the under surface 30 thereof and comprises a U-shaped mounting bracket 35 having a base 34 which is secured to the under surface 30 of the seat forming element 4, and a pair of spaced apart side plates 41 extending from the base 34. A transversely extending pivot pin 36 is carried by the side plates 41, and pivotally carries a ratchet lever 37. The ratchet lever 37 defines with the base 34 and the side plates 41 of the mounting bracket 35 a passageway 39, through which the grippable element 32 of the limit strap 17 is urgeable in the directions of the arrows A and B for altering the effective length of a portion 38 of the limit strap 17 extending between the back engaging element 3 adjacent the first strap accommodating slot 25 and the seat forming element 4 adjacent the second strap accommodating slot 26, for in turn altering the limit of upward travel of the seat forming element 4 relative to the back engaging element 3. By urging the grippable element 32 through the passageway 39 in the direction of the arrow A, the effective length of the portion 38 of the limit strap 17 extending between the back engaging element 3 and the seat forming element 4 is shortened, thereby urging the seat forming element 4 downwardly towards the back engaging element 3 against the upwardly directed resilient force induced in the seat forming element 4 by the resilient mounting members 8.

A first tooth engaging element 40 extends from the ratchet lever 37 into the passageway 39 for releasably engaging a selected one of the ratchet teeth 33 on the grippable element 32 for setting the effective length of the portion 38 of the limit strap 17 extending between the back engaging element 3 and the seat forming element 4 for in turn setting the limit of upward travel of the seat forming element 4 relative to the back engaging element 3. A torsion spring (not shown) located on the pivot pin 36 and acting between the mounting bracket 35 and the ratchet lever 37 resiliently urges the first tooth engaging element 40 into engagement with the ratchet teeth 33 on the grippable element 32 of the limit strap 17.

An incrementing lever 42 is also pivotal on the pivot pin 36, and comprises a second tooth engaging element 43. The incrementing lever 42 is pivotal in the direction of the arrow C away from the ratchet lever 37 towards the grippable element 32 for bringing the second tooth engaging element 43 into engagement with the ratchet teeth 33 of the grippable element 32, for in turn incrementing the grippable element 32 of the limit strap 17 through the passageway 39, one ratchet tooth 33 at a time in the direction of the arrow A for fine adjustment of the effective length of the portion 38 of the limit strap 17 extending between the back engaging element 3 and the seat forming element 4. Pivoting of the incrementing lever 42 and the ratchet lever 37 towards each other in the directions of the arrows D releases the first and second tooth engaging elements 40 and 43 from the ratchet teeth 33 on the grippable element 32 to provide for quick release of the ratchet mechanism 20 to in turn provide for free movement of the grippable element 32 in the directions of the arrows A and B, and in particular in the direction of the arrow B through the passageway 39 for coarse adjustment of the effective length of the portion 38 of the limit strap 17 extending between the back engaging element 3 and the seat forming element 4.

The second strap accommodating slot 26 is located substantially centrally in the seat forming element 4, and substantially midway between the pommel 5 and the cantle 6. The first strap accommodating slot 25 is located substantially centrally in the back engaging element 3, and thus, the first strap accommodating slot 25 is located substantially directly beneath the second strap accommodating slot 26. In this embodiment of the invention the second strap accommodating slot 26 being located in the seat forming element 4 substantially midway between the pommel 5 and the cantle 6, is located at a location in the seat forming element 4 through which the load carried by the seat forming element 4 acts. Accordingly, the portion 38 of the limit strap 17 substantially coincides with the line of action through which the load carried by the seat forming element 4 acts, thereby avoiding, or at least minimising turning moments being induced in the seat forming element 4 about the limit strap 17 as the seat forming element 4 reaches the limit of its upward travel, and thus any danger of a rider being toppled from the seat forming element 4 and/or damage to the seat forming element 4 is avoided, which could otherwise result if such turning moments were induced in the seat forming element 4.

The saddle tree 1 including the seat forming element 4 and the back engaging element 3, including the side panels 10, the coupling element 12 and the resilient mounting members 8 is formed in one piece from reinforced polymer, which in this case comprises a reinforced polypropylene material. The polypropylene material is reinforced by layers of matting of fiberglass fabric. In this embodiment of the invention the seat forming element 4 and the side panels 10 of the back engaging element 3 are reinforced with three layers of the matting. However, in order to enhance the resilience with which the side panels 10 are coupled through the coupling element 12, the coupling element 12 is reinforced with five layers of the matting.

Additionally, in order to increase the resilience with which the seat forming element 4 is resiliently coupled to the side panels 10 by the resilient mounting members 8, and also to provide sufficient strength in the resilient mounting members 8 to cantilever the seat forming element 4 rearwardly from the resilient mounting members 8, the resilient mounting members 8 are reinforced with five layers of matting.

To complete the saddle tree 1 so that it is usable by a rider, the seat forming element 4 is upholstered, padded and covered in conventional fashion with leather or other suitable materials. The back engaging element 3 including the side panels 10, the coupling element 12 and the resilient mounting members 8 are also suitably padded and covered with leather or other suitable materials. Additionally, when covering the seat forming element 4, the ratchet mechanism 20 and the grippable element 32 of the limit strap 17 are left exposed.

In use, with the saddle tree 1 suitably upholstered, covered and padded, the saddle tree 1 is ready for use. The saddle tree 1 is mounted on an animal, and is secured to the animal in conventional fashion. Stirrups and other ancillary equipment are also secured to the saddle tree 1.

To set the limit of upward travel of the seat forming element 4 relative to the back engaging element 3, the grippable element 32 of the limit strap 17 is manually urged through the passageway 39 of the ratchet mechanism 20 in the direction of the arrow A for coarse adjusting of the effective length of the portion 38 of the limit strap 17 extending between the back engaging element 3 and the seat forming element 4. As the grippable element 32 is being urged through the passageway 32 in the direction of the arrow A, the first tooth engaging element 40 sequentially engages the ratchet teeth 33. Fine adjusting of the effective length of the portion 38 of the limit strap 17 extending between the back engaging element 3 and the seat forming element 4 is achieved with the incrementing lever 42 by alternately pivoting the incrementing lever 42 in the directions of the arrows C and D, so that the second tooth engaging element 43 urges the grippable element 32 through the passageway 39 in the direction of the arrow A one tooth 33 of the ratchet teeth 33 at a time. When the effective length of the portion 38 of the limit strap 17 extending between the back engaging element 3 and the seat forming element 4 has been set to produce the desired limit of upward movement of the seat forming element 4 relative to the back engaging element 3, the first tooth engaging element 40 by engaging the selected one of the ratchet teeth 33 of the grippable element 32, sets the limit of upward travel of the seat forming element 4 relative to the back engaging element 3.

The more the grippable element 32 is urged in the direction of the arrow A through the passageway 39 of the ratchet mechanism 20, the shorter will be the portion 38 of the limit strap 17 extending between the back engaging element 3 and the seat forming element 4, and thus, the greater will be the limit imposed on the upward travel of the seat forming element 4 relative to the back engaging element 3, and in turn the harder will be the seat forming element 4. In other words, the amount of upward travel of the seat forming element 4 relative to the back engaging element 3 permitted will be reduced. However, to reduce the hardness of the seat forming element 4, the grippable strap 32 is urged in the direction of the arrow B through the passageway 39 of the ratchet mechanism 20, thereby increasing the length of the portion 38 of the limit strap 17 extending between the back engaging element 3 and the seat engaging element 4, and in turn, increasing the limit of upward travel of the seat forming element 4 relative to the back engaging element 3 permitted during riding, thus providing a softer seat.

While the limit means for adjusting the limit of upward travel of the seat forming element 4 relative to the back engaging element 3 has been described as comprising a limit strap directly anchored to the back engaging element 3, and adjustably coupled to the seat forming element 4 by a ratchet mechanism, any other suitable adjusting means for adjusting the limit of upward travel of the seat forming element 4 relative to the back engaging element 3 may be provided. While the provision of a ratchet mechanism is advantageous, in that it permits incremental adjustment of the limit of upward travel of the seat forming element 4 relative to the back engaging element 3, and also provides quick release of the limit strap 17, other suitable adjusting means for adjustably connecting the limit strap to the seat forming element 4 may be provided. Needless to say, other suitable limit means besides a limit strap, for example, a limit ligature or other such suitable limit means may be provided.

It will also be appreciated that while the limit strap has been described as being anchored to the back engaging element 3 and adjustably coupled to the seat forming element 4, the limit strap could be anchored directly to the seat forming element 4 and adjustably coupled to the back engaging element 3. Needless to say, any other suitable limit means could be similarly anchored to either the seat forming element 4 or the back engaging element 3 and adjustably connected to the other one of the seat forming element and the back engaging element.

While the saddle tree has been described as being formed in one piece, while this is desirable, it is not essential.

It will also be appreciated that while the saddle tree has been described as comprising polypropylene material reinforced with fiberglass fabric matting, any other suitable materials may be used. Needless to say, any other suitable construction of a coupling element and resilient mounting members may be provided. Additionally, the seat forming element may be coupled to the back engaging element by any other suitable resilient mounting means, for example, by compression springs. Furthermore, any suitable number of layers of the fiberglass fabric for reinforcing the polypropylene material of the saddle tree or any other fabric matting may be used, and typically, the number of layers of the fiberglass fabric or other matting will range from one layer up to ten layers.

The invention claimed is:

1. A saddle tree comprising:

a back engaging element for engaging the back of an animal, a seat forming element resiliently mounted on the back engaging element and being resiliently moveable relative to the back engaging element, a limit means connected between the seat forming element and the back engaging element for limiting upward travel of the seat forming element relative to the back engaging element, and a ratchet mechanism adjustably coupling the limit means to one of the back engaging element and the seat forming element for adjustably setting a limit of upward travel of the seat forming element relative to the back engaging element.

2. A saddle tree as claimed in claim 1 in which the limit means is connected between the seat forming element and the back engaging element intermediate a pommel and a cantle of the seat forming element.

3. A saddle tree as claimed in claim 2 in which the limit means is connected between the seat forming element and the back engaging element substantially midway between the pommel and the cantle of the seat forming element.

4. A saddle tree as claimed in claim 2 in which a resilient mounting means extending between the back engaging element and the seat forming element resiliently couples the seat forming element to the back engaging element.

5. A saddle tree as claimed in claim 4 in which the resilient mounting means is configured to permit resilient movement of the seat forming element relative to the back engaging element in a generally upwardly/downwardly direction.

6. A saddle tree as claimed in claim 4 in which the resilient mounting means is located adjacent the pommel, and the seat forming element is cantilevered rearwardly from the resilient mounting means towards the cantle.

7. A saddle tree as claimed in claim 4 in which the limit means is connected between the seat forming element and the back engaging element at respective locations spaced apart rearwardly from the resilient mounting means.

8. A saddle tree as claimed in claim 4 in which the back engaging element comprises a pair of side panels for engaging the back of the animal on respective opposite sides of the spine of the animal, and the side panels of the back engaging element terminate in the resilient mounting means adjacent the pommel, the resilient mounting means comprises a pair of spaced apart mounting members extending upwardly from the respective ones of the side panels of the back engaging element adjacent the pommel, the mounting members engaging the seat forming element adjacent the pommel for resiliently coupling the seat forming element to the side panels, and the side panels of the back engaging element are connected together intermediate the pommel and the cantle by a coupling element of a resilient material for resiliently coupling the side panels of the back engaging element to each other intermediate the pommel and the cantle.

9. A saddle tree as claimed in claim 8 in which the limit means is coupled to the back engaging element adjacent the coupling element.

10. A saddle tree as claimed in claim 1 in which the limit means is connected to the seat forming element at a location through which the load borne by the seat forming element acts.

11. A saddle tree as claimed in claim 1 in which the limit means is anchored to one of the back engaging element and the seat forming element, and is adjustably coupled to the other one of the back engaging element and the seat forming element by the ratchet mechanism.

12. A saddle tree as claimed in claim 1 in which the ratchet mechanism comprises:

a ratchet element carried on one of (i) the limit means, or (ii) the one of the seat forming element and the back engaging element to which the limit means is coupled by the ratchet mechanism, and a plurality of spaced apart ratchet teeth located on the other one of (i) the limit means, and (ii) the one of the seat forming element and the back engaging element to which the limit means is coupled by the ratchet mechanism, the ratchet element being releasably engageable with a selected one of the ratchet teeth for adjusting an effective length of the limit means extending between the back engaging element and the seat forming element.

13. A saddle tree as claimed in claim 12 in which the ratchet teeth are located on the limit means.

14. A saddle tree as claimed in claim 1 in which the ratchet mechanism is configured to permit quick release of the limit means from the one of the seat forming element and the back engaging element to which the limit means is coupled by the ratchet mechanism.

15. A saddle tree as claimed in claim 1 in which the ratchet mechanism is located on the seat forming element.

16. A saddle tree as claimed in claim 1 in which the limit means comprises a flexible limit member.

17. A saddle tree as claimed in claim 1 in which the limit means comprises an elongated limit member extending between the back engaging element and the seat forming element.

18. A saddle tree as claimed in claim 1 in which the limit means comprises a limit strap.

19. A method for limiting upward travel of a seat forming element of a saddle tree relative to a back engaging element of the saddle tree whereby the back engaging element of the saddle tree is configured for engaging the back of an animal, and the seat forming element is resiliently mounted on the back engaging element for permitting relative movement of the seat forming element relative to the back engaging element, the method comprising connecting a limit means between the seat forming element and the back engaging element for limiting the upward travel of the seat forming element relative to the back engaging element, and adjustably coupling the limit means to one of the back engaging element and the seat forming element by a ratchet mechanism for adjustably setting a limit of upward travel of the seat forming element relative to the back engaging element.

* * * * *